United States Patent [19]

Gange

[11] 4,026,780

[45] May 31, 1977

[54] METHOD AND APPARATUS FOR CATAPHORETIC DEPOSITION

[75] Inventor: Robert Allen Gange, Belle Mead, N.J.

[73] Assignee: RCA Corporation, New York, N.Y.

[22] Filed: Apr. 5, 1976

[21] Appl. No.: 673,988

[52] U.S. Cl. ..... 204/181; 204/300 EC; 204/199

[51] Int. Cl.[2] ..... C25D 13/16; C25D 17/00

[58] Field of Search ..... 204/300 EC, 181, 199

[56] References Cited

UNITED STATES PATENTS

| | | | |
|---|---|---|---|
| 3,024,184 | 3/1962 | Bowes et al. | 204/300 EC |
| 3,385,774 | 5/1968 | Thompson et al. | 204/199 |
| 3,476,666 | 11/1969 | Bell et al. | 204/181 |

*Primary Examiner*—Howard S. Williams
*Attorney, Agent, or Firm*—Glenn H. Bruestle; Carl L. Silverman

[57] ABSTRACT

An elongated cylindrical conductive body is cataphoretically coated with insulating material. The coating is substantially uniform in thickness. The method includes the use of a rotating cylindrical tube which is substantially filled with a suspension of the material to be deposited. The cylindrical body is disposed with its major axis along the longitudinal axis of the tube. An electric field is provided inside the tube which is radially symmetrical about the longitudinal axis of the tube. Homogeneity of the suspension is maintained by rotating the tube at constant rates and by orienting the longitudinal axis of the tube orthogonally to the force of gravity. The method can be used to construct a line electron filament which is substantially uniform in cross section about its longitudinal axis. Such a filament is particularly useful as a cathode in a display which employs space charge limited emission operation.

10 Claims, 4 Drawing Figures

METHOD AND APPARATUS FOR CATAPHORETIC DEPOSITION

BACKGROUND OF THE INVENTION

This invention relates to cataphoretic depositions, and particularly to a method and apparatus in which a coating of insulating material of substantially uniform thickness can be obtained on and around an elongated body.

Cataphoretic deposition is a well-known technique for the deposition of insulating materials. It is widely used for the deposition of electron emissive material, e.g., emission carbonates. For example, one such method is disclosed in U.S. Pat. No. 3,020,244 entitled, "Method and Device for Applying Electron Emissive Coatings to Coating Supports of Indirectly Heated Thermionic Cathodes of Electrical Discharge Tubes," issued to H. H. Bland et al. on Feb. 6, 1962.

Conventional cataphoretic techniques are satisfactory for many purposes, e.g., fabricating electron filaments. However, these methods are incapable of creating coatings which are substantially uniform in thickness. This lack of uniformity is primarily due to two factors. Conventional depositions are taken from suspensions which are inhomogeneous due to settling of the particles in the suspension, and the electric field employed during the deposition is not radially symmetrical about the cylindrical body.

The nonuniformities caused by conventional cataphoretic depositions are particularly undesirable where a line source of thermionic electrons is desired. A line filament, i.e., a line source of thermionic electrons, would be useful as the cathode in a flat image display device. However, for a satisfactory display, it is desirable that the line filament operate under space charge limited emission conditions. Otherwise, the output current would be highly temperature dependent. In space charge limited emission, the distance between the filament and the effective anode through which the electrons are collected must be accurately maintained. For such an application, the conventional cataphoretically deposited filaments are unsatisfactory, resulting in unacceptable nonuniformity.

SUMMARY OF THE INVENTION

A method of cataphoretic deposition for obtaining coatings of insulating material which are substantially uniform in thickness on and around an elongated body includes placing a body to be coated into a cylindrical tube. The body is disposed with its major axis along the longitudinal axis of the tube and maintained under tension in fixed relation to the tube. The body includes at least a surface portion which is an electrical conductor. The tube includes an electrically conductive body on and along its inner circumference. The tube includes a suspension of the material to be deposited. The cylindrical tube is rotated about its longitudinal axis at a substantially constant rate while the tube is oriented such that the force of gravity acts orthogonally to the longitudinal axis of the tube. Then, an electrical field is established between the conductive body on the inner circumference of the cylindrical tube and the body to be coated. The electric field is such that the body to be coated has a substantially constant surface charge density.

DETAILED DESCRIPTION OF THE INVENTION

Figure 1:
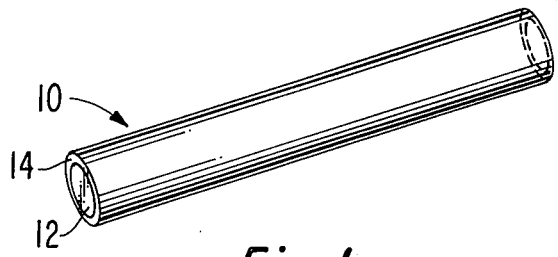
FIG. 1 is a perspective view of one form of an electron filament obtained through the method of the present invention.

Referring initially to FIG. 1, an electron filament is generally designated as 10. The filament 10 is constructed through the use of the method and apparatus of the present invention. The filament 10 includes a cylindrical body 12 of a refractory metal, such as tungsten. The tungsten body 12 has a diameter of about 250 microns and a length which is generally at least 100 times its diameter with minimum ratios of 1000 to 1 being typical. A layer 14 of emission carbonate is concentrically disposed on and around the tungsten body 12 and along the longitudinal axis thereof. The emission carbonate may comprise about 13% $CaCO_3$, 31% $SrCO_3$, and 56% $BaCO_3$. The layer 14 of the emission carbonate has a thickness of about 40 microns.

The filament 10 is substantially uniform in cross section about its longitudinal axis. That is, variations in the diameter of the filament 10 are less than about 25 microns. This is in contrast to the much larger variations, e.g., often greater than 125 microns, found in filaments constructed through conventional deposition techniques. In addition, under high magnification, I have observed that the coatings obtained through the method of the present invention are appreciably more uniform than those produced through conventional spray coating techniques.

Figure 2:
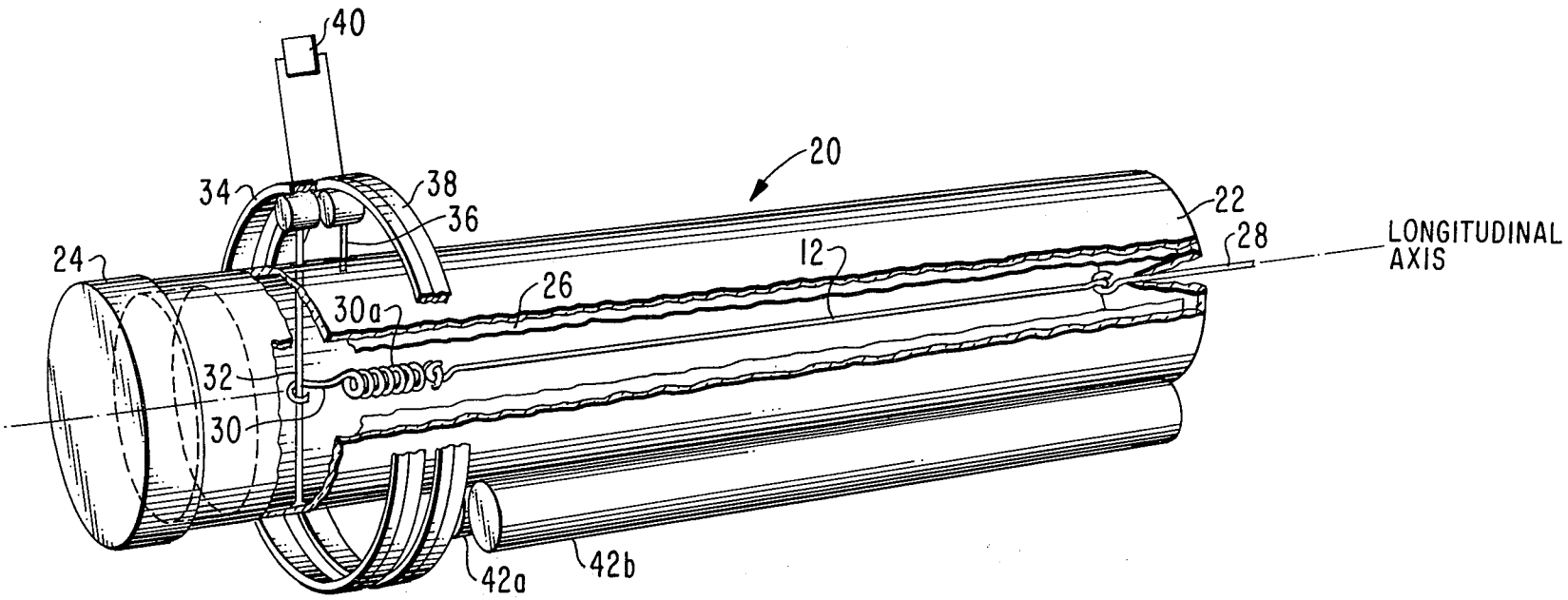
FIG. 2 is a partially broken away perspective view showing one form of an apparatus of the present invention.

The filament 10 is constructed through the use of the apparatus 20 of FIG. 2. The apparatus 20 includes an elongated cylindrical tube 22 of insulating material, e.g., quartz or pyrex. A body 26 of electrically conductive material, i.e., a cylindrical nickel foil layer 26, is disposed on and along the inner circumference of the cylindrical tube 22. The nickel foil layer 26 substantially covers the inner circumference of the tube 22. The tube 22 has an inner radius of about 2 cm. A stopper 24 of insulating material, e.g., ground glass, is held at one end of the tube 22 by any suitable means, e.g., rubber bands (not shown). The other end of the tube 22 is sealed. The tube 22 should be of a length such that the nickel foil layer 26 extends beyond both ends of the particular body to be coated. The foil layer 26 should be of sufficient length so as to extend a distance beyond the ends of the body to be coated. This distance should be at least equal to the radius of the tube 22, preferably two or three times the radius.

The cylindrical body 12 to be cataphoretically coated is disposed in the tube 22 with its major axis along the longitudinal axis thereof and placed under tension by a pair of hook feedthroughs 28 and 30. The hook feedthrough 28 extends through the sealed end and out of the tube 22. The hook feedthrough 30 includes a spring portion 30*a* which hooks onto a fixed electrical terminal 32. The fixed terminal 32 is disposed in orthogonal relation to the longitudinal axis of the tube 22. The terminal 32 extends beyond the circumference of the tube 22 so as to make electrical contact to a slip ring electrode 34 which lies outside the tube 22 and is concentric therewith. Another fixed terminal 36 (partially shown) is electrically connected to the body 26 of conductive material and extends beyond the circumference of the tube 22 so as to make electrical contact to a slip ring electrode 38. The slip ring electrodes 34 and 38 are electrically connected to a source 40 of electrical energy which can produce a suitable output, e.g., 200 volts at greater than 1mA per inch of length of the body 12.

Disposed outside of the tube 22 are a pair of rollers 42*a* and 42*b* (partially shown). The respective axes of the rollers 42*a* and 42*b* are in parallel relation to the axis of the tube 22. The circumferences of the rollers 42*a* and 42*b* are each in abutting relation with the circumference of the tube 22. Thus, rotation of the rollers 42*a* and 42*b* about their respective axes causes rotation of the tube 22 about its longitudinal axis. The rollers 42*a* and 42*b* are mechanically connected to a source which can rotate at a uniform rate (not shown). The source of rotation should be capable of causing the tube 22, when filled, to rotate at constant rates of at least 80 rpm.

In the construction of the filament 10 of FIG. 1, a carefully drawn cylindrical body 12 of tungsten is placed along the axis of the tube 22 of FIG. 2 and maintained under tension therein so as to be in fixed relation to the tube 22. Preferably, the body 12 is fixed in relation to the tube 22 in the sense that neither can be moved or rotated separately, as shown in FIG. 2. For example, the tension should be sufficient to produce an acceptable catenary, e.g., about $7 \times 10^3$ psi. The tube 22 is then substantially filled with a suspension of the emission carbonate. The emission carbonate may consist of 13% $CaCO_3$, 31% $SrCO_3$, and 56% $BaCO_3$ in an electrolyte. The electrolyte may be ethyl methacrylate binder in acetone and calcium nitrate. The tube 22 is then rotated about its longitudinal axis at constant rates of about 80 rpm for at least 24 hours prior to the cataphoretic deposition. During the rotation of the tube 22, its positioning is such that the force of gravity acts orthogonally to the longitudinal axis of the tube 22. This ensures a substantially uniform distribution of the cataphoretic suspension in the tube.

Then, while continuing to rotate the tube 22, an electrical field is provided to the tungsten body 12 and nickel foil layer 26 through the source 40 and the slip ring electrodes 34 and 38, respectively. The electrical field has a direction which causes the nickel foil layer 26 to function as an anode and the cylindrical body 12 to function as a cathode whereby cataphoretic deposition occurs. That is, the emission carbonate material deposits on and around the cylindrical tungsten body 12 which is held at ground potential. Cataphoretic deposition would also occur if the electrical field were reversed. However, I believe the result would be a weaker bond of the emissive layer to the cylindrical body 12. The thickness of the emission carbonate deposit on and around the tungsten body 12 is controlled by the duration and magnitude of the applied voltage. I have found that 175 volts across the 2cm tube radius for 7 seconds typically results in a cataphoretic carbonate deposition of the order of 25 microns in thickness. Typical field gradients within the tube are between about 50 volt/cm and about 150 volt/cm, with about 88 volt/cm being preferable.

The depositions of the emissive material obtained through this method are extremely uniform in thickness. The uniformity is due to the homogeneous composition of the emission carbonate suspension during the cataphoretic deposition and the radial symmetry of the electric field distribution provided by axially disposing the cylindrical body 12 within the cylindrical nickel foil layer 26. With this geometry, the anode 26 i.e., nickel foil layer, completely surrounds the body 12 so that the body 12 has a substantially constant surface charge density. That is, there is a constant number of electrical field lines per unit surface area. This ensures uniformity of deposition so as to result in a deposited layer of substantially uniform thickness. Furthermore, in this method, air gaps within the tube 22 are held to a minimum such that alteration of the electric field strength due to differences in polarization between the regions with and without air gaps is avoided.

Although the method and apparatus of the present invention have been described for use in coating a tungsten cylindrical body with an emission coating which is substantially uniform in thickness, many variations in structure and dimension are possible. For instance, the cylindrical body to be coated need not be an electrical conductor. It is only necessary that the body to be cataphoretically coated include at least a surface portion which is an electrical conductor, i.e., a suitable cathode (or anode) material. This means that the method and apparatus are suitable for constructing indirectly heated filaments in which the emissive layer is not deposited directly on a conductive cylindrical body. However, in such a case, it may be necessary that the cylindrical body include a conductive exterior surface. Then, this surface of electrically conductive material can function as the cathode (or anode) for the emissive material during the cataphoretic deposition. Furthermore, the conductive surface portion which functions as the cathode during the cataphoretic disposition need not be an exterior surface; it can be an interior surface. For example, during the cataphoretic deposition process, insulating material continues to be deposited on the initially deposited insulating material.

Also, for some applications, it may be acceptable if the cylindrical body to be coated is in fixed relation to the tube in the sense that it is axially located therein but capable of separate rotation. For example, the tube could include bearings in contact with the body to be coated such that the tube would be capable of separate rotation about the body to be coated (not shown).

In addition, the method and apparatus of the present invention are useful for the deposition of many insulating materials, not merely emission carbonates. For example, other materials which can be successfully deposited include all cataphoretic suspensions, such as ceramic coatings including alumina. This means that an ultrafine conductive filament can be cataphoretically coated with a transparent insulating material, such as silicon dioxide. Such a coating would be substantially uniform in thickness so as to be desirable for use in fiber optic applications. Also, the method and apparatus of the present invention are suitable in the construction of coaxial cables of minute size. For example, the method and apparatus can be employed in the construction of low impedance transmission lines in which the small separation between an inner conductor and an outer conducting sheath needs to be critically controlled.

Figure 3:
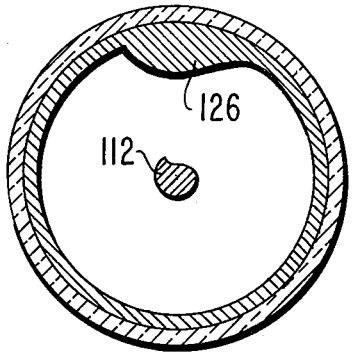
FIGS. 3 and 4 are cross-sectional views of a portion of the apparatus of FIG. 2 showing modifications thereto.
Figure 4:
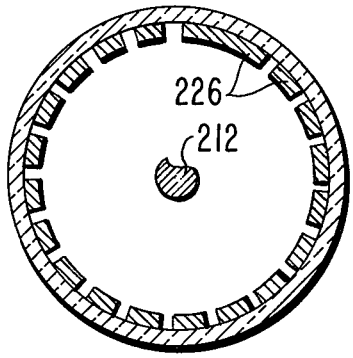

Although the method and apparatus have been described for use in the coating of a cylindrical body, variations are possible. That is, the body to be coated need not be perfectly cylindrical; slight variations in its cross section will not substantially affect the uniformity of a subsequent cataphoretic deposition. In fact, bodies of noncylindrical elongated shapes can be coated with conformal insulating layers of substantially uniform thickness. However, in such a case, it is essential that the body to be coated has a substantially constant surface charge density during the cataphoretic deposition. This can be accomplished in several ways. For example, the conductive body 126 which functions as an anode (or cathode) during the cataphoretic deposition can be suitably shaped so as to correspond to the body 112 to be coated, as shown in FIG. 3. That is, the conductive body 126 cooperates with the body 112 to be coated to produce a constant surface charge density. Or, the conductive body 226 which functions as the anode can be patterned around the body 212 to be coated in such a way so as to approximate a uniform surface charge density during the cataphoretic deposition, as shown in FIG. 4. Also, although not shown, the patterned portions of the conductive body 226 can be provided with a common electrical potential from a single source of electrical energy. Or, if desired, the patterned portions can also be provided with different electrical potentials so as to approximate the uniform surface charge density at the body 212.

I claim:

1. A method of cataphoretic deposition for obtaining coatings of insulating material which are substantially uniform in thickness on and around an elongated body, which comprises:

a. placing said body to be coated into a cylindrical tube with the major axis of said body being disposed along the longitudinal axis of said tube and maintained under tension in fixed relation to said tube, said body including at least a surface portion which is an electrical conductor, said tube including an electrically conductive body on and along its inner circumference, said tube having therein a suspension of the material to be deposited, b. rotating said cylindrical tube about its longitudinal axis at a substantially constant rate with said tube being oriented such that the force of gravity acts orthogonally to the longitudinal axis of said tube, and then c. establishing an electric field between said conductive body on said inner circumference of said tube and said body to be coated while rotating said tube with said electric field being such that said body to be coated has a substantially constant surface charge density.

2. A method in accordance with claim 1 which includes substantially filling said tube with said suspension of said material to be deposited.

3. A method in accordance with claim 2 in which said electric field is such that said body to be coated functions as a cathode.

4. A method in accordance with claim 2 which includes rotating said cylindrical tube about its longitudinal axis for at least 24 hours before performing step *c.*

5. A method in accordance with claim 4 which includes rotating said tube at about 80 rpm.

6. A method in accordance with claim 1 in which said body to be coated comprises an electrical conductor.

7. A cataphoretic deposition apparatus for obtaining an insulating layer of substantially uniform thickness on and around a surface of an elongated body, which comprises:

a. a cylindrical tube having a body of conductive material on and along its inner circumference, b. means for fastening said body to be coated in fixed relation along the longitudinal axis of said tube and under tension therein, c. means for rotating said cylindrical tube about its longitudinal axis, d. means for electrically connecting to said body to be coated while said tube is rotating about its axis, e. means for electrically connecting to said body of conductive material on said inner surface of said tube while said tube is rotating about its axis, and f. means for establishing an electrical field between said body to be coated and said body of conductive material, said electrical field being such that said body to be coated has a substantially constant surface charge density.

8. An apparatus in accordance with claim 7 in which said electrically conductive body substantially covers said inner circumference of said tube.

9. An apparatus in accordance with claim 7 in which said body of conductive material is cylindrical in shape.

10. An apparatus in accordance with claim 7 in which said body of conductive material has a shape which cooperates with said body to be coated so as to achieve said substantially constant surface charge density.

* * * * *

UNITED STATES PATENT OFFICE
CERTIFICATE OF CORRECTION

PATENT NO. : 4,026,780

DATED : May 31, 1977

INVENTOR(S) : Robert Allen Gange

It is certified that error appears in the above-identified patent and that said Letters Patent are hereby corrected as shown below:

| | | |
|---|---|---|
| Column 1 | Line 16 | "3,020,244" should be --3,020,224-- |
| | Line 19 | "Bland" should be --Blank--. |

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*